US009166380B2

(12) United States Patent
Baus

(10) Patent No.: US 9,166,380 B2
(45) Date of Patent: Oct. 20, 2015

(54) SPARK PLUG ELECTRODE MATERIAL AND SPARK PLUG

(75) Inventor: Simone Baus, Bamberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 115 days.

(21) Appl. No.: 14/111,863

(22) PCT Filed: Feb. 15, 2012

(86) PCT No.: PCT/EP2012/052563

§ 371 (c)(1),
(2), (4) Date: Dec. 27, 2013

(87) PCT Pub. No.: WO2012/139791

PCT Pub. Date: Oct. 18, 2012

(65) Prior Publication Data

US 2014/0125214 A1 May 8, 2014

(30) Foreign Application Priority Data

Apr. 15, 2011 (DE) ..... 10 2011 007 532

(51) Int. Cl.

| | |
|---|---|
| ***H01T 13/06*** | (2006.01) |
| ***H01T 13/39*** | (2006.01) |
| ***H01T 21/02*** | (2006.01) |
| ***C22C 19/03*** | (2006.01) |
| ***C22F 1/10*** | (2006.01) |
| ***C22C 19/05*** | (2006.01) |

(52) U.S. Cl.
CPC ..... *H01T 13/39* (2013.01); *C22C 19/03* (2013.01); *C22C 19/05* (2013.01); *C22F 1/10* (2013.01); *H01T 21/02* (2013.01)

(58) Field of Classification Search
USPC ..... 313/118–145
See application file for complete search history.

(56) References Cited

U.S. PATENT DOCUMENTS

| | | | |
|---|---|---|---|
| 2,958,598 | A | 11/1960 | Douglas |
| 2007/0114900 | A1 | 5/2007 | Lykowski |
| 2008/0308057 | A1 | 12/2008 | Lykowski et al. |

FOREIGN PATENT DOCUMENTS

| | | |
|---|---|---|
| DE | 102009046005 | 4/2011 |
| FR | 858196 | 11/1940 |
| JP | H04370686 | 12/1992 |
| JP | 2007214136 | 8/2007 |

OTHER PUBLICATIONS

International Search Report for PCT/EP2012/052563, issued on Jul. 9, 2012.

*Primary Examiner* — Mariceli Santiago
*Assistant Examiner* — Brenitra M Lee
(74) *Attorney, Agent, or Firm* — Kenyon & Kenyon LLP

(57) ABSTRACT

A spark plug electrode material containing nickel, silicon, and copper, the electrode material, in the case of proper use, forming a nickel oxide layer made of nickel oxide grains on at least a part of its surface, the grain boundary phase of the nickel oxide grains including silicon and/or silicon oxide.

25 Claims, 3 Drawing Sheets

SPARK PLUG ELECTRODE MATERIAL AND SPARK PLUG

FIELD OF THE INVENTION

The present invention relates to a spark plug electrode material and a spark plug including an electrode, which is formed from the spark plug electrode material, and a method for manufacturing the spark plug electrode material.

BACKGROUND INFORMATION

Spark plugs are known in the related art in various embodiments. In gasoline engines, spark plugs generate ignition sparks for igniting the fuel-air mixture between their electrodes. The spark plugs have ground electrodes and center electrodes for this purpose, spark plug configurations having two to five electrodes being known. The electrodes are introduced either onto the spark plug housing (ground electrode) or as the center electrodes into a ceramic insulator for this purpose. The service life of a spark plug is influenced by the corrosion and erosion resistance of the electrode material. Conventional electrode materials are based on nickel alloys having aluminum components. However, these have the problem that under operating conditions in the engine compartment, i.e., in the case of high temperatures and oxidizing atmosphere, a majority of the nickel surface and also part of the nickel in the interior of the electrode material are oxidized by reactions with the surrounding oxygen. A nickel oxide layer is thus formed, which also contains aluminum oxide and has both thermally insulating properties and also properties which suppress the electrical conductivity. It thus tends toward corrosion or spark-erosive erosion already after a short time. In this way, the electrode spacing is enlarged, which finally results in failure of the spark plug. The formation of an oxide layer in the case of proper use of the spark plug may be achieved, however, by the use of electrode materials made of pure noble metal or based on noble metal, for example, platinum or platinum alloys with iridium, which have an increased resistance with respect to wear against spark-erosive attacks. However, such electrode materials, in particular platinum, result in enormous costs, which are problematic in the case of mass-produced parts of this type such as spark plugs.

SUMMARY

The spark plug electrode material according to the present invention has the advantage over the related art that it is based on a nickel-based alloy, which keeps the costs of the electrode material and therefore those of the spark plug low. Furthermore, this spark plug electrode material has the advantage that in the case of proper use, i.e., in the case of elevated temperature and the presence of oxygen, a specifically structured, particularly homogeneous, relatively thin oxide layer made of nickel oxide grains forms on at least a part of its surface within an extremely short time, typically already after a few hours. The structure of the oxide layer is distinguished in that a boundary layer—a so-called grain boundary phase—forms between the oxide grain boundaries of the forming nickel oxide layer, which has an advantageous effect on the spark-erosive wear, whereby the ablation of the electrode material by spark erosion is reduced, and therefore the service life of the spark plug electrode is lengthened. Due to the targeted addition of silicon to the nickel-based starting electrode material (nickel-based alloy), the grain boundary phase of the nickel oxide grains includes silicon and/or silicon oxide in the case of proper use of the electrode material. The grain boundary phase of the nickel oxide grains is preferably formed from silicon and/or silicon oxide in the case of proper use of the electrode material. The thermomechanical, electrical, and/or heat-conductive properties of the oxide layer are advantageously influenced by this formation of the grain boundary phase, including silicon and/or silicon oxide. Furthermore, in addition to the electrical conductivity of the forming oxide layer, the oxidation resistance thereof, and also the thermodynamic stability thereof, are improved, whereby in turn the spark-erosive wear of the electrode material is reduced. Thus, during the operation of the spark plug electrode material according to the present invention, an oxide layer made of in particular nickel oxide grains, which has a grain boundary phase and which includes silicon and/or silicon oxide or is made of silicon and/or silicon oxide, is thus formed on at least a part of the surface of the electrode material. This oxide layer has a high thermal conductivity, preferably of 6 W/mK, in particular of at least 8 W/mK, or even of 10 W/mK or more, and a particularly high electrical conductivity. The voltage which is applied to and the temperature which acts on the electrode material during its proper use may thus rapidly be distributed uniformly to the entire electrode material, whereby local, i.e., limited to a small area of the electrode surface, temperature maxima and voltage maxima are prevented, which significantly reduces the corrosion and erosion of the electrode material.

The present invention therefore follows a new path, since by targeted selection of the components of the electrode material, specifically nickel, copper, and silicon, an oxide layer forming during proper use is optimized, and attention is not focused on the highest possible corrosion resistance, as in the related art.

Quantity specifications of the individual elements and compounds refer hereafter, if not otherwise indicated, in each case to the total weight of the spark plug electrode material.

The spark plug electrode material according to the present invention is preferably distinguished in that the grain boundary phase of the nickel oxide grains also contains copper and/or copper oxide in addition to silicon and/or silicon oxide. However, the main proportion of copper and/or copper oxide primarily accumulates in the nickel oxide grains. The thermomechanical, electrical, and/or heat-conductive properties of the oxide layer are further advantageously influenced by a grain boundary phase of the nickel oxide grains, which also includes copper and/or copper oxide in addition to silicon and/or silicon oxide.

The spark plug electrode material according to the present invention is preferably distinguished in that the content of silicon and/or silicon oxide in the nickel oxide layer is 1 wt.-% to 5 wt.-%, in particular 2 wt.-% to 4 wt.-%, and in particular 3 wt.-% in relation to the total weight of the nickel oxide layer. The content of silicon and/or silicon oxide in the nickel oxide layer is understood to be the proportion of silicon and/or silicon oxide which is present in the grain boundary phase. This proportion is easily measurable, for example, by energy-dispersive x-ray spectroscopy (EDX) on the scanning electron microscope. A significant increase of the electrical conductivity of the oxide layer is already measurable from a small proportion of approximately 1 wt.-% silicon and/or silicon oxide at the grain boundary phase of the nickel oxide grains, which increases up to a content of silicon and/or silicon oxide of approximately 5 wt.-% at the grain boundary phase. An opposing effect occurs at still higher proportions, however. The content of silicon and/or silicon oxide is preferably therefore in a range of 2 wt.-% to 4 wt.-% in relation to the total weight of the nickel oxide layer.

Furthermore, the spark plug electrode material is preferably distinguished in that approximately 90% of the nickel oxide grains and in particular approximately 95% of the nickel oxide grains have a grain size of less than 15 μm. The formation of nickel oxide grains having the smallest possible grain size is essential for the formation of a nickel oxide layer of nickel oxide grains which have a homogeneous distribution of the silicon-containing grain boundary phase. The smaller the grain size of the nickel oxide grains, the more stable is the forming oxide layer in addition. This is to be attributed to the fact that small grains form a denser formation of nickel oxide grains, whereby the formation of larger cavities, and therefore of so-called intended breakpoints, is avoided. A sufficient stability of the electrode material according to the present invention including a nickel oxide layer made of nickel oxide grains having grain boundary phases is achieved if at least 90% and in particular 95% of the nickel oxide grains, which form in the case of proper use of the spark plug electrode material, have a grain size of less than 15 μm. A grain size of the nickel oxide grains of less than 15 μm may be produced, for example, by a spark plasma acting on the electrode material according to the present invention.

It is particularly preferable if, before the proper use of the spark plug electrode material, the content of silicon is 0.7 wt.-% to 1.3 wt.-%, in particular 0.9 wt.-% to 1.1 wt.-%, in particular 1 wt.-%, and the content of copper is 0.5 wt.-% to 1.0 wt.-%, in particular 0.60 wt.-% to 0.85 wt.-%, in particular 0.75 wt.-%, and/or the content of nickel is therefore approximately 97.5 wt.-% to 98.5 wt.-%, in relation to the total weight of the electrode material. The oxidation behavior of the electrode material and the electrical resistance of the oxide layer forming on the electrode material are already positively influenced at a small proportion of silicon of 0.7 wt.-%, by the fact that, in the case of proper use of the spark plug electrode material, a sufficient quantity of silicon and/or silicon oxide of approximately 1 wt.-% to 5 wt.-% of the silicon is used in the grain boundary phase of the nickel oxide grains. From a total proportion of silicon of greater than 1.3 wt.-%, however, an opposing effect occurs. By adding copper at a proportion of 0.5 wt.-% to 1.0 wt.-% in relation to the total weight of the electrode material, the electrical resistance of the electrode material is reduced further, since the copper ions are primarily intercalated in the nickel oxide lattice, whereby the electrical conductivity of the forming oxide layer is increased. This effect is already measurable from a low copper proportion of 0.5 wt.-%. The proportion of the copper is not to exceed 1 wt.-%, however, since otherwise sufficient mechanical strength of the spark plug electrode material may no longer be sufficiently ensured. The spark plug electrode material therefore particularly preferably has a content of silicon of 0.9 wt.-% to 1.1 wt.-% and in particular 1 wt.-%, and a content of copper of 0.6 wt.-% to 0.85 wt.-%, in particular 0.75 wt.-%. In these proportions, the added elements silicon and copper result, due to the accumulation and enrichment of silicon and/or silicon oxide or of silicon and/or silicon oxide and copper and/or copper oxide at the grain boundary phases of the nickel oxide grains of the nickel oxide layer forming in the case of proper use of the spark plug electrode material, in particularly high electrical conductivity of the oxide layer. The forming oxide layer is also sufficiently thermodynamically and mechanically stable, so that the spark-erosive wear and the corrosion of the spark plug electrode material according to the present invention are also effectively reduced.

Furthermore, the spark plug electrode material according to the present invention is preferably distinguished in that the layer thickness of the grain boundary phase is less than 0.3 μm, in particular less than 0.2 μm, and in particular less than 0.1 μm. The thinner the grain boundary phase is formed, the smaller are the cavities between the nickel oxide grains and therefore the more closed and stable is the oxide layer surface, so that it is better protected against spark-erosive attacks, since it therefore only has a small proportion of intended breakpoints. The layer thickness of the grain boundary phases is preferably at least great enough, however, for the individual silicon atoms and/or silicon oxide particles to be able to accumulate thereon. In particular, the layer thickness of the grain boundary phases is therefore greater than 0.1 nm and less than 0.2 μm and in particular less than 0.1 μm.

According to another preferred embodiment of the present invention, the spark plug electrode material according to the present invention is distinguished in that it contains, in addition to nickel, copper, and silicon, 0.07 wt.-% to 0.13 wt.-%, in particular 0.09 wt.-% to 0.11 wt.-%, and in particular 0.10 wt.-% yttrium. The addition of such small quantities of yttrium prevents abnormal grain growth during the proper use of a spark plug, which has the spark plug electrode material according to the present invention. They yttrium content may be kept low intentionally, for example, by a low oxygen content of the alloy. From a proportion of greater than 0.13 wt.-%, the oxidation behavior and therefore also the electrical resistance of the forming oxide layer are negatively influenced, since yttrium-containing deposits form in the electrode material.

According to another preferred embodiment of the present invention, the spark plug electrode material is distinguished by a proportion of metallic impurities which is in total less than 0.2 wt.-% and in particular less than 0.1 wt.-%. Metallic impurities include elements and compounds, such as iron, titanium, chromium, manganese, and the like. Such impurities reduce the effect of the increase of the electrical conductivity, as is achieved by adding silicon and copper in the specified range to the nickel base material. In addition, the thermal conductivity of the alloy is reduced by these impurities.

In particular, it is preferable when the nickel oxide grains do not contain any silicon and/or silicon oxide. If silicon or silicon oxide is intercalated in the nickel oxide grains, it competes therein with the copper particles (copper ions) or with copper oxide, whereby the electrical conductivity of the electrode material according to the present invention may not be efficiently increased.

The electrode material is particularly preferably essentially free of aluminum and/or aluminum compounds and/or intermetallic phases. Aluminum and its compounds reduce the electrical conductivity of the electrode material and the forming oxide layer and therefore promote the spark-erosive wear of the electrode material. By omitting aluminum, the oxidation behavior and in particular the electrical resistance of the forming oxide layer and therefore the erosion behavior of the spark plug electrode material are significantly improved, i.e., measurably improved. In addition, the shaping ability of the material is significantly improved. Omitting intermetallic phases has a similar effect, because intermetallic phases exist as deposits in the nickel matrix and result in thermomechanical tensions and a reduction of the thermal conductivity, whereby the spark-erosive wear and the corrosion of the electrode material are increased.

It is particularly preferable if the content of iron and/or chromium and/or titanium is less than 0.05 wt.-% and in particular less than 0.01 wt.-% and/or the content of sulfur and/or sulfur compounds and/or carbon and/or carbon compounds is less than 0.01 wt.-%, in particular less than 0.005 wt.-%, and in particular less than 0.001 wt.-%. In particular the elements iron and/or chromium and/or titanium influence the electrical conductivity of the electrode material in a disadvantageous way. More preferably, the content of sulfur and/or sulfur compounds and/or carbon and/or carbon compounds is less than 0.01 wt.-%, in particular less than 0.005 wt.-%, and in particular less than 0.001 wt.-%, since these elements and compounds also have negative effects on the oxidation behavior of the alloy; in particular, they may result in increased corrosion of the electrode material.

It is particularly preferable if the content of oxygen in the spark plug electrode material is less than 0.003 wt.-%, in particular less than 0.002 wt.-%, since oxygen promotes oxidation not only of the nickel material, but also of any impurities, which in turn contributes to increased wear of the electrode material.

According to another preferred embodiment of the present invention, the spark plug electrode material essentially includes, i.e., neglecting technically related, unavoidable impurities, 1 wt.-% silicon, 0.75 wt.-% copper, and 0.1 wt.-% yttrium, the remaining material consisting of nickel and making up approximately 98.15 wt.-%. Such an electrode material forms, in the case of proper use, a stable, thin, and uniform nickel oxide layer having fine grain boundary phases, on which silicon and/or silicon oxide or silicon and/or silicon oxide and copper and/or copper oxide is/are deposited. This electrode material has a high thermal conductivity of greater than 10 W/mK and a low electrical resistance, i.e., a high electrical conductivity. The spark plug electrode material therefore has a reduced spark-erosive wear and a significantly reduced tendency to corrode and is therefore perfectly suited for continuous use at high temperatures.

Furthermore, the spark plug electrode material preferably is essentially made, i.e., neglecting technically related, unavoidable impurities, of 0.7 wt.-% to 1.3 wt.-%, in particular 1 wt.-% silicon, 0.5 wt.-% to 1.0 wt.-%, in particular 0.75 wt.-% copper, 0.07 wt.-% to 0.13 wt.-%, in particular 0.1 wt.-% yttrium, and contains less than 0.003 wt.-%, in particular less than 0.002 wt.-% oxygen, 0.001 wt.-% sulfur and 0.003 wt.-% carbon, the remaining material being nickel, the proportion of mechanical impurities being in total less than 0.1 wt.-%. This electrode material has minimal spark-erosive wear and minimal corrosion tendency because of its composition.

Furthermore, the present invention relates to a method for manufacturing the spark plug electrode material according to the present invention, the method including the steps of manufacturing a nickel-based alloy and adding further elements, such as silicon, copper, and optionally yttrium.

Due to the proper use of the thus manufactured spark plug electrode material according to the present invention, an oxide layer, which has an optimized structure, is formed on at least one part of the surface of the spark plug electrode material. An optimized structure is understood to mean that the oxide layer is distinguished by a uniform and stable composite and additionally is relatively thin and flat on the surface in comparison to oxide layers forming on conventional electrodes. Furthermore, grain boundary phases, which contain silicon and/or silicon oxide, are formed between the nickel oxide grains. This allows the formation of an electrode material having a low electrical resistance of the oxide layer on the electrode surface, which results in improved electrical conductivity of this oxide layer. In addition, the thermal conductivity of the electrode material is also increased. By way of the method according to the present invention, a spark plug electrode made of cost-effective electrode material is therefore provided, which is distinguished by extremely high temperature resistance and significantly reduced spark-erosive wear and electrode burnoff and has outstanding oxidation and corrosion resistance. The spark plug electrode manufactured according to the present invention is therefore stable and wear-resistant even at high temperatures under extreme conditions, such as those prevailing in the combustion chamber of an engine.

Furthermore, the present invention relates to an electrode made of the above-described spark plug electrode material, the electrode being able to be used, for example, as a center electrode and/or as a ground electrode of a spark plug, and both as a one-material electrode or as a two-material electrode having the electrode material according to the present invention as a jacket material and a copper core.

Furthermore, the present invention relates to the use of nickel, silicon, and copper for manufacturing an alloy for a spark plug electrode material, which is distinguished by very good electrical conductivity and also high thermal conductivity, and therefore a long service life.

DETAILED DESCRIPTION

Figure 1:
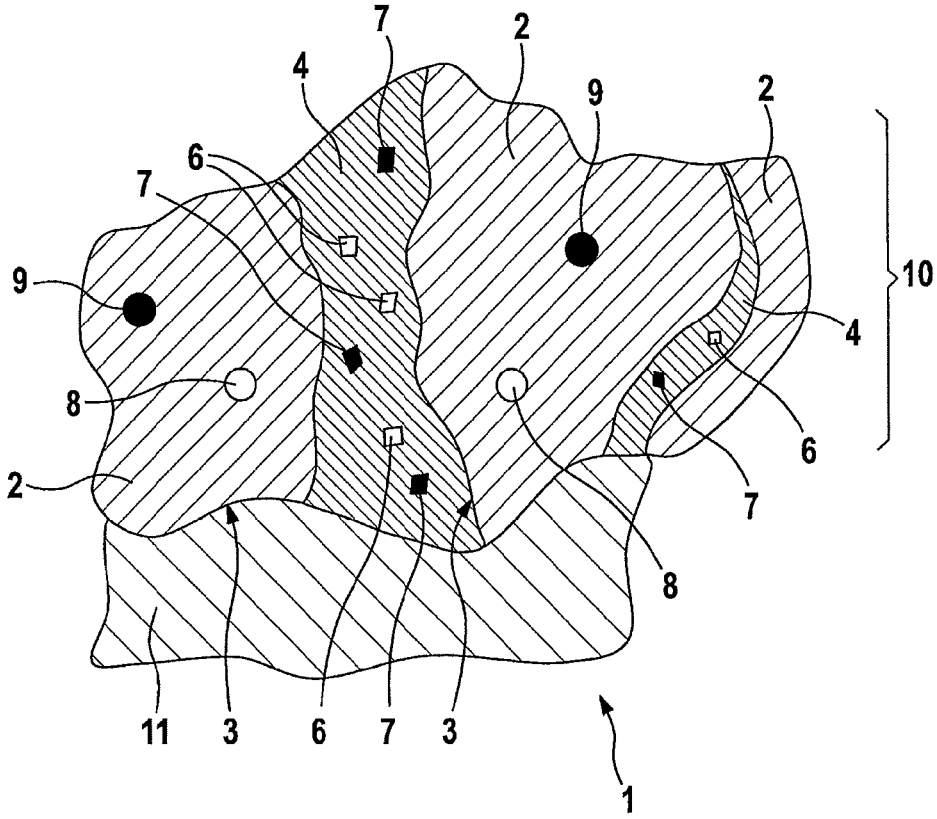
FIG. 1 shows a schematic sectional view of the spark plug electrode material according to the present invention.

FIG. 1 shows a schematic sectional view of spark plug electrode material 1 according to the present invention. By way of the proper use of electrode material 1, a nickel oxide layer 10, which includes nickel oxide grains 2 having grain boundaries 3, is formed on the surface of nickel alloy 11, a grain boundary phase 4 being located between nickel oxide grains 2, the grain boundary phases being shown exaggeratedly large in this schematic sectional view.

Nickel oxide grains 2 contain copper particles (copper ions) 8 and copper oxide particles 9, which are intercalated in the nickel oxide lattice (not shown) of nickel oxide layer 10. Grain boundary phase 4 includes silicon particles 6 and silicon oxide particles 7. A nickel oxide layer 10 formed in this way is distinguished by high thermodynamic stability, high thermal conductivity, and outstanding electrical conductivity.

Figure 2:
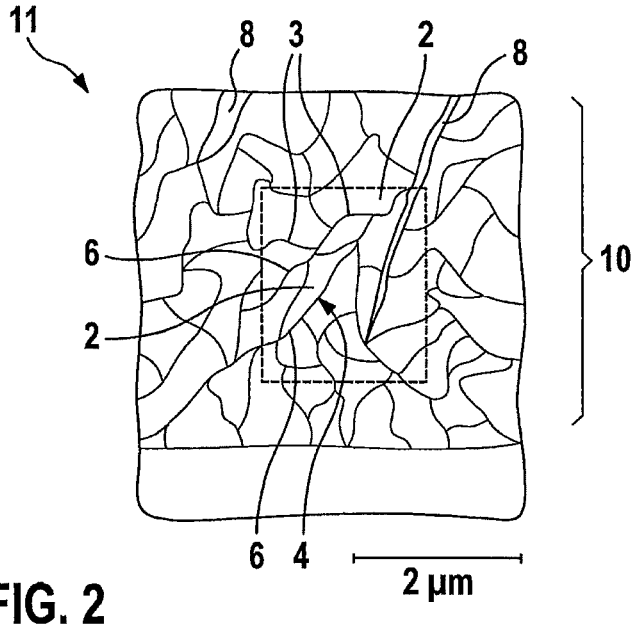
FIG. 2 shows another schematic view of a detail of the oxide layer of the spark plug electrode material according to the present invention.

FIG. 2 is a schematic view of a detail of nickel oxide layer 10 of spark plug electrode material 1 according to the present invention, the spark plug electrode material essentially consisting of 1 wt.-% silicon, 0.75 wt.-% copper, and 98.25 wt.-% nickel before formation of the oxide layer. Grain boundary phases 4, which contain silicon 6, are formed between nickel oxide grains 2 having their grain boundaries 3. Two cracks 8, which may form in nickel oxide layer 10, are also shown as examples.

Figure 3:
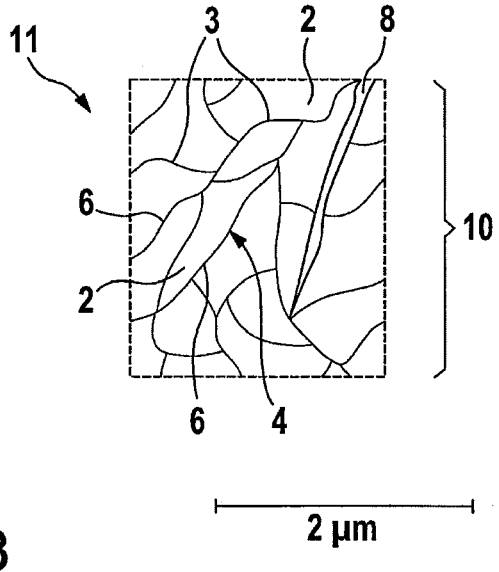
FIG. 3 shows a view of the framed section from FIG. 2 having an enlarged view of the detail of the oxide layer of the spark plug electrode material according to the present invention.

FIG. 3 is an enlarged view of the framed section of the spark plug electrode material according to the present invention from FIG. 2. Silicon 6 or silicon oxide 7, which is enriched in grain boundary phases 4, is particularly well visible here.

Figure 4:
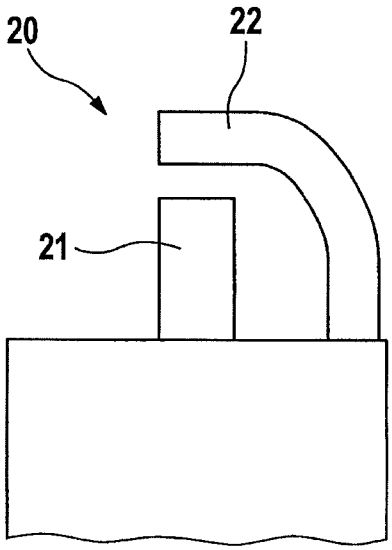
FIG. 4 shows a spark plug including the spark plug electrode material according to the present invention.

FIG. 4 shows a spark plug 20 in the sense of the present invention, having a center electrode 21 and a ground electrode 22, both center electrode 21 and ground electrode 22 being formed from the spark plug electrode material according to the present invention, and ground electrode 22 being designed as a one-material electrode and center electrode 21 being designed as a two-material electrode.

According to the present invention, a spark plug electrode material for manufacturing a spark plug electrode or in general a spark plug is therefore provided, which is distinguished, because of the formation of an oxide layer, in particular in the case of proper use, by low spark-erosive wear and outstanding corrosion resistance with minimized manufacturing costs and sufficient thermodynamic stability and mechanical stability.

What is claimed is:

1. A spark plug electrode material, comprising:

nickel, silicon, and copper, wherein the electrode material forms a nickel oxide layer made of nickel oxide grains on at least a part of its surface as a result of exposure to an oxidizing and high temperature environment, a grain boundary phase of the nickel oxide grains including at least one of silicon and silicon oxide.

2. The spark plug electrode material as recited in claim 1, wherein the grain boundary phase of the nickel oxide grains further includes at least one of copper and copper oxide.

3. The spark plug electrode material as recited in claim 1, wherein a content of the at least one of silicon and silicon oxide in the nickel oxide layer is 1 wt.-% to 5 wt.-%.

4. The spark plug electrode material as recited in claim 1, wherein approximately 90% of the nickel oxide grains have a grain size of less than 15 μm.

5. The spark plug electrode material as recited in claim 1, wherein, before the exposure, the content of silicon is 0.7 wt.-% to 1.3 wt.-%.

6. The spark plug electrode material as recited in claim 5, wherein, before the exposure: the content of copper is 0.5 wt.-% to 1.0 wt.-%, and the content of nickel is approximately 97.5 wt.-% to 98.5 wt.-%.

7. The spark plug electrode material as recited in claim 1, wherein a layer thickness of the grain boundary phases is less than 0.3 μm.

8. The spark plug electrode material as recited in claim 1, further comprising 0.07 wt.-% to 0.13 wt.-% yttrium.

9. The spark plug electrode material as recited in claim 1, wherein a proportion of metallic impurities is in total less than 0.2 wt.-%.

10. The spark plug electrode material as recited in claim 1, wherein the nickel oxide grains do not contain any of the at least one of silicon and silicon oxide.

11. The spark plug electrode material as recited in claim 1, wherein the electrode material is essentially free of at least one of aluminum, aluminum compounds, and intermetallic phases.

12. The spark plug electrode material as recited in claim 1, wherein a combined content of any of iron, chromium, and titanium is less than 0.05 wt.-%.

13. The spark plug electrode material as recited in claim 12, wherein a combined content of any of sulfur, sulfur compounds, carbon, and carbon compounds is less than 0.01 wt.-%.

14. The spark plug electrode material as recited in claim 1, wherein a content of oxygen is less than 0.003 wt.-%.

15. The spark plug electrode material as recited in claim 1, wherein the electrode material includes: (a) approximately 98.15 wt.-% nickel, (b) 1 wt.-% silicon, (c) 0.75 wt.-% copper, and (d) 0.1 wt.-% yttrium.

16. The spark plug electrode material as recited in claim 1, wherein, before the exposure, the content of nickel is approximately 97.5 wt.-% to 98.5 wt.-%.

17. The spark plug electrode material as recited in claim 1, wherein, before the exposure, the content of copper is 0.5 wt.-% to 1.0 wt.-%.

18. The spark plug electrode material as recited in claim 1, wherein a combined content of any of sulfur, sulfur compounds, carbon, and carbon compounds is less than 0.01 wt.-%.

19. A method for manufacturing a spark plug electrode material including nickel, silicon, and copper, wherein the electrode material forms a nickel oxide layer made of nickel oxide grains on at least a part of its surface as a result of exposure to an oxidizing and high temperature environment, a grain boundary phase of the nickel oxide grains including at least one of silicon and silicon oxide, the method comprising:

manufacturing a nickel-based alloy; and adding further elements.

20. A spark plug including an electrode made of a spark plug electrode material including nickel, silicon, and copper, wherein the electrode material forms a nickel oxide layer made of nickel oxide grains on at least a part of its surface as a result of exposure to an oxidizing and high temperature environment, a grain boundary phase of the nickel oxide grains including at least one of silicon and silicon oxide.

21. The spark plug as recited in claim 20, wherein the electrode is a center electrode with a copper core.

22. The spark plug as recited in claim 20, wherein the electrode is a center electrode without a copper core.

23. The spark plug as recited in claim 20, wherein the electrode is a ground electrode with a copper core.

24. The spark plug as recited in claim 20, wherein the electrode is a ground electrode without a copper core.

25. A method of manufacturing a spark plug electrode material, comprising:

providing and using an alloy that includes nickel, silicon, and copper, wherein at least one of:

a composition of the alloy is such that, when exposed to an oxidizing and high temperature environment, a nickel oxide layer forms, the nickel oxide layer including nickel oxide grains separated by grain boundary phases, with at least a predominant amount of at least one of copper and copper oxide in the nickel oxide layer being included in the nickel oxide grains and with at least a predominant amount of at least one of silicon and silicon oxide in the nickel oxide layer being included in the grain boundary phases; and the alloy further includes 0.07 wt.-% to 0.13 wt.-% yttrium.

* * * * *